US006523934B1

(12) United States Patent
Beauchamp et al.

(10) Patent No.: US 6,523,934 B1
(45) Date of Patent: Feb. 25, 2003

(54) VARIABLE POSITIONING OF A PRINTHEAD

(75) Inventors: Robert W. Beauchamp, Carlsbad, CA (US); Michael J. Klausbruckner, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/596,351

(22) Filed: Jun. 17, 2000

(51) Int. Cl.[7] ..... B41J 23/00
(52) U.S. Cl. ..... 347/37; 347/40
(58) Field of Search ..... 347/37, 40, 234, 347/14

(56) References Cited

U.S. PATENT DOCUMENTS 5,359,355 A * 10/1994 Nagoshi et al. ..... 347/9
5,924,804 A * 7/1999 Hino et al. ..... 400/118.2
6,003,969 A * 12/1999 Freret, Jr. ..... 347/40
6,092,887 A * 7/2000 Tanino et al. ..... 347/37

* cited by examiner

*Primary Examiner*—Craig Hallacher

(57) ABSTRACT

An inkjet printer includes a printhead having a slant angle that can be changed as a function of primitive spacing. Increasing the slant angle allows printing speed to be increased.

25 Claims, 6 Drawing Sheets

FIG. 1
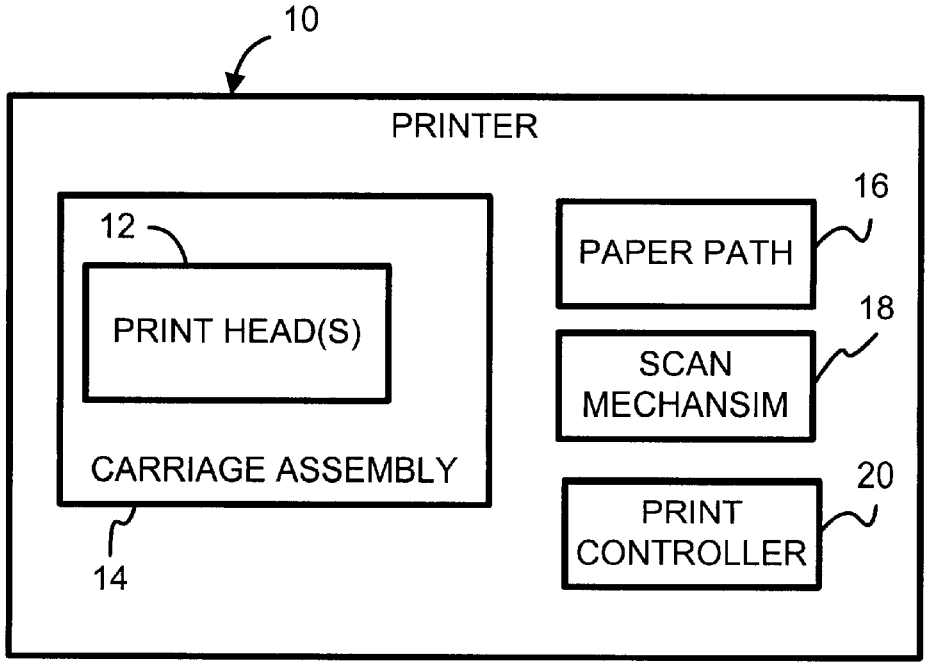
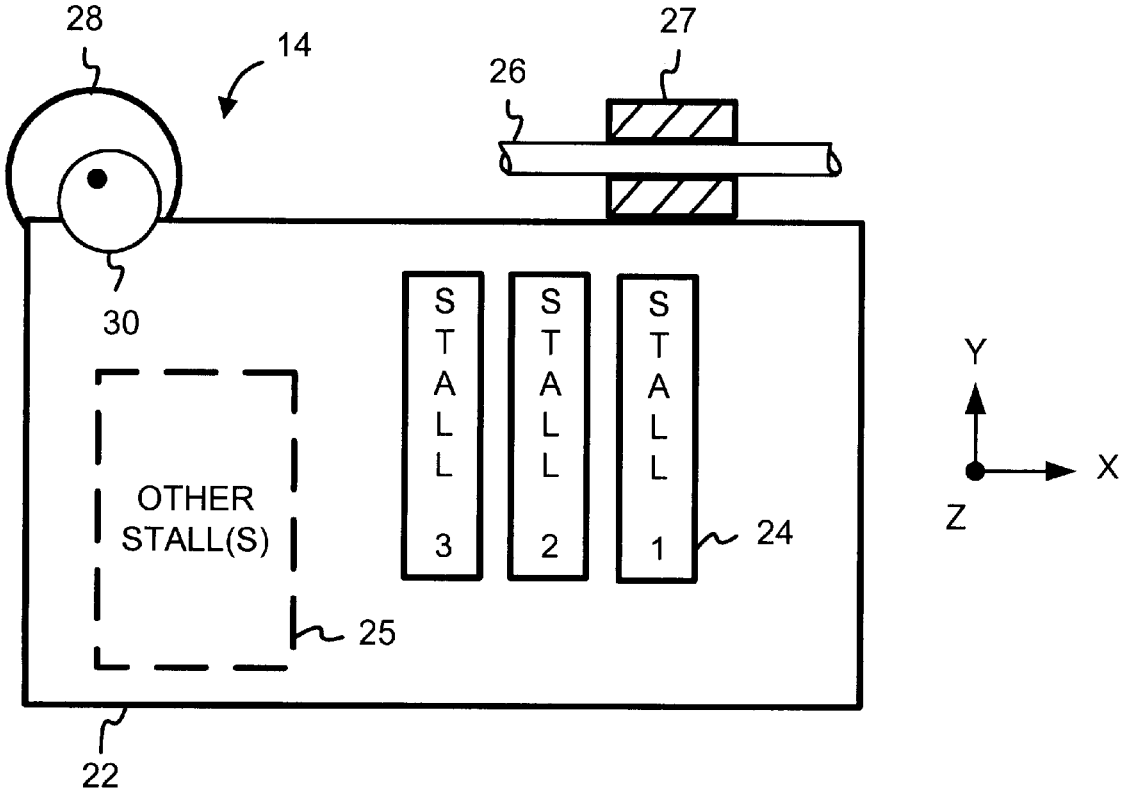
FIG. 2

VARIABLE POSITIONING OF A PRINTHEAD

BACKGROUND OF THE INVENTION

The present invention relates to inkjet printers. More specifically, the present invention relates to inkjet printers that are commonly used in large-scale, industrial printing applications. Such applications include, without limitation, printing bar codes, envelopes, labels and checks.

A typical thermal inkjet printer includes at least one printhead. Each printhead includes one or two columns of vertically-oriented nozzles. Each nozzle ejects a color ink dot when thermally actuated. During a printing operation, a sheet is moved along a paper flow axis. Each printhead may be scanned across the sheet along a scan axis. As each printhead is scanned across the sheet, it can lay down a swath of ink dots. A b/w printhead can lay down swaths of black dots; and a typical tri-color printhead can lay down swaths of cyan, magenta and yellow dots.

High printing speed is desirable, especially for large print jobs. However, printing speed is limited by several factors. All of the nozzles in a column are not fired simultaneously because firing a column of nozzles simultaneously would result in high power consumption. Firing a column of nozzles simultaneously would also "starve" the nozzle fluid chamber. To reduce power consumption and avoid fluid problems, the nozzles are usually fired sequentially through small subgroups called "primitives." Within each primitive, the nozzles are fired in succession, from a first nozzle to a last nozzle.

Firing frequency of the nozzles limits the speed at which the printhead is scanned across a sheet. If the scan speed is increased beyond a limit, printing a vertical line becomes difficult because the nozzles move past the vertical line before they can be fired. Without compensation for scan speed, the line will be twisted.

It would be desirable to increase the speed at which the printhead is scanned, especially for large-scale, industrial printing applications. Increasing the scan speed would reduce printing time.

SUMMARY OF THE INVENTION

According to one aspect of the present invention, a printer includes a printhead stall rotatable about a Z-axis; a mechanism for rotating the printhead stall about the Z-axis; and a controller for controlling the mechanism to change slant angle of the printhead stall as a function of primitive spacing.

Other aspects and advantages of the present invention will become apparent from the following detailed description, taken in conjunction with the accompanying drawings, illustrating by way of example the principles of the present invention.

BRIEF DESCRIPTION OF THE DRAWINGS

FIG. 1 is an illustration of an inkjet printer according to the present invention;

FIG. 2 is an illustration of a carriage assembly for the inkjet printer;

DETAILED DESCRIPTION OF THE INVENTION

Figure 3:
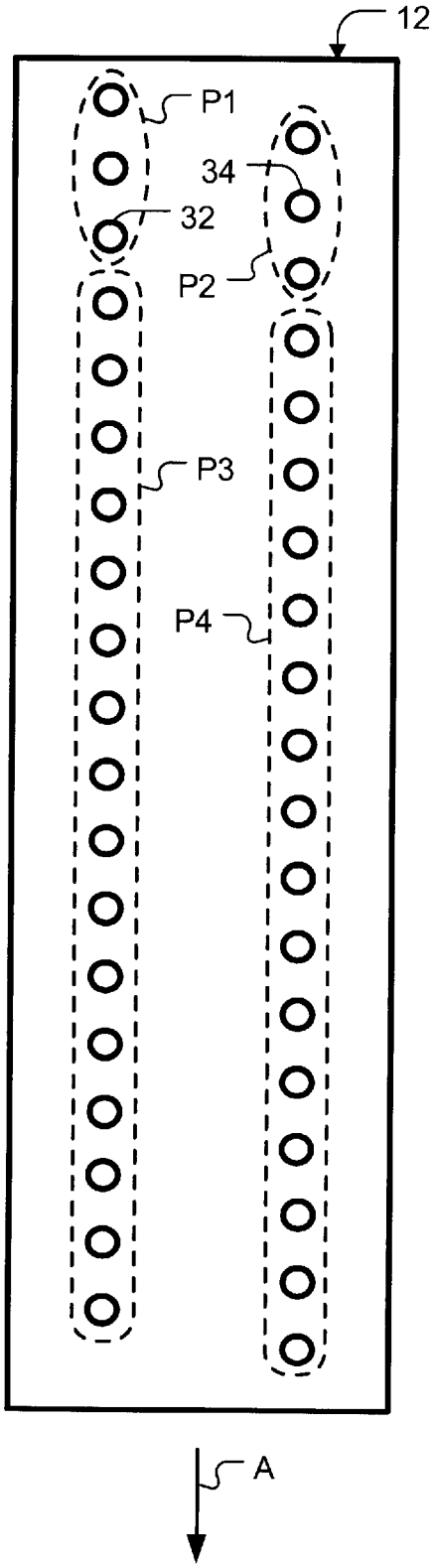
FIG. 3 is an illustration of a plurality of nozzles of a printhead.

As shown in the drawings for purposes of illustration, the present invention is embodied in an inkjet printer. Using a printhead having a standard pair of nozzle columns, the inkjet printer can print as much as six times faster than a conventional printer using the same printhead. Moreover, the inkjet printer does not produce gaps between printed swaths.

FIG. 1 shows an inkjet printer 10 including one or more printheads 12, a carriage assembly 14 for carrying the printheads 12, a paper path 16 for advancing a sheet or other print medium beneath the printheads 12, and a scan mechanism 18 for scanning the printheads 12 across the sheet. The printer 10 also includes a printer controller 20 (e.g., an embedded processor and embedded read-only memory storing firmware for the processor) for receiving swath data from a host (e.g. a host computer) and using the swath data to fire nozzles of the printheads 12. Each bit of the swath data indicates whether a printhead nozzle should be actuated at a specific position along the sheet. The printer controller 20 also controls the carriage assembly 14, the paper path 16 and the scan mechanism 18.

FIG. 2 shows the carriage assembly 14 in greater detail. The carriage assembly 14 includes a mounting plate 22 and three printhead stalls 24 secured to the mounting plate 22. Each printhead stall 24 accommodates a printhead. FIG. 2, for example, shows three stalls 24 that accommodate three printheads (e.g., a cyan printhead, a magenta printhead and a yellow printhead). The three stalls 24 are in-line. A dashed portion 25 represents additional stalls that may be offset with respect to the three in-line stalls 24.

The scan mechanism 18 may include a rail 26 and a bushing 27. The bushing 27 secures the mounting plate 22 to the rail 26 and allows the mounting plate 22 to slide along the rail 26 in the direction of a scan axis (i.e., the X-axis). The scan mechanism 18 further includes a motor (e.g., a stepper motor, a servo DC motor) and transmission for moving the mounting plate 22 along the rail 26. The motor and transmission are not shown in FIG. 2.

A mechanism including a stepper motor 28 and a cam 30 can rotate the mounting plate 22 about a Z-axis (the axis going into the page). The cam 30 may have a circular profile, but it is rotated off-center. A surface of the cam 30 comes in contact with a surface of the mounting plate 22. Rotating the cam 30 off-center causes the mounting plate 22 to rotate about the Z-axis. It is preferable to rotate the nozzle plate about its center to minimize nozzle translation along the X-axis. The print controller 20 commands the stepper motor 28 to rotate the cam 30. The printer controller 20 controls the motor 28 to change slant angle of the printhead 12 in proportion to printing speed. The specific angles of rotation will be described below.

During a print operation, the paper path 16 moves a sheet in incremental distances along a paper flow axis (i.e., the Y-axis). After the sheet has been moved into a print zone, the scan mechanism 18 moves the mounting plate 22 in the scan direction at a scan velocity. The printer controller 20 causes the nozzles to fire and deposit color dots on the sheet as the mounting plate 22 is scanned along the sheet. After a swath of dots has been printed across the sheet, the printer controller 20 commands the paper path 14 to advance the sheet by an incremental distance. The printer controller 20 also sends a request for new swath data. After the swath data has been received, the printer 10 prints a new swath of dots. The printer 10 continues printing swaths until the sheet has been printed.

FIG. 3 shows the printhead 12 with first and second columns of nozzles 32, 34. The printhead 12 has a total of 524 nozzles, only thirty eight of which are shown. The nozzles 32 of the first column are vertically and horizontally offset with respect to the nozzles 34 of the second column. The nozzles 32 and 34 are oriented along a pen axis A.

Figure 4:
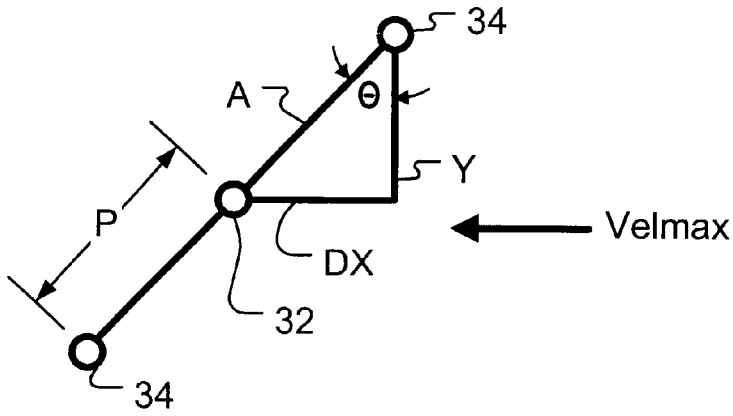
FIG. 4 is an illustration of three nozzles of the printhead.

Referring additionally to FIG. 4, the nozzles 32 and 34 are separated by a distance that is a function of maximum firing frequency, relative velocity of the paper beneath the printhead and resolution in the scan direction (along the X-axis). The relationship for displacement (Dx) may be expressed as follows:

$$Dx=N/\mathrm{Resx}$$

where Resx is resolution in the scan axis, and N is the number of nozzles per primitive. Maximum carriage velocity (Velmax) may be expressed as $$\mathrm{Velmax}=\mathrm{Freqmax}/\mathrm{Resx}$$

where Freqmax is the maximum frequency at which drops are fired from the printhead 12.

The printhead 12 is slanted to compensate for the scan velocity relative to the firing frequency. The slant angle (θ) of the printhead 12 may be expressed as $$\theta=\arctan(\mathrm{Resx}^{-1}P^{-1})$$

where P is the primitive separation. In this instance, the slant angle is the angle between the pen axis A and the paper flow axis Y. The scan direction is perpendicular to the pen axis A when the slant angle equals zero. The primitive separation (P) may be expressed as P=N/Resy, where Resy represents the nozzle spacing along the pen axis A. For a firing frequency of 12 KHz, a scan resolution (Resx) of 600 dpi, a nozzle spacing (Resy) of 300 dpi and sixteen nozzles per primitive, the slant angle (θ) is $$\theta=\arctan(600^{-1}(16/300)^{-1})=1.79 \text{ degrees.}$$

The maximum carriage velocity (Velmax) is 20 inches per second ("ips"). At such a slant angle (θ) and carriage velocity (Velmax), the printer 10 can print vertical lines at a resolution of 600 dpi in the scan direction, which is perpendicular to the paper flow direction.

Figure 5A:
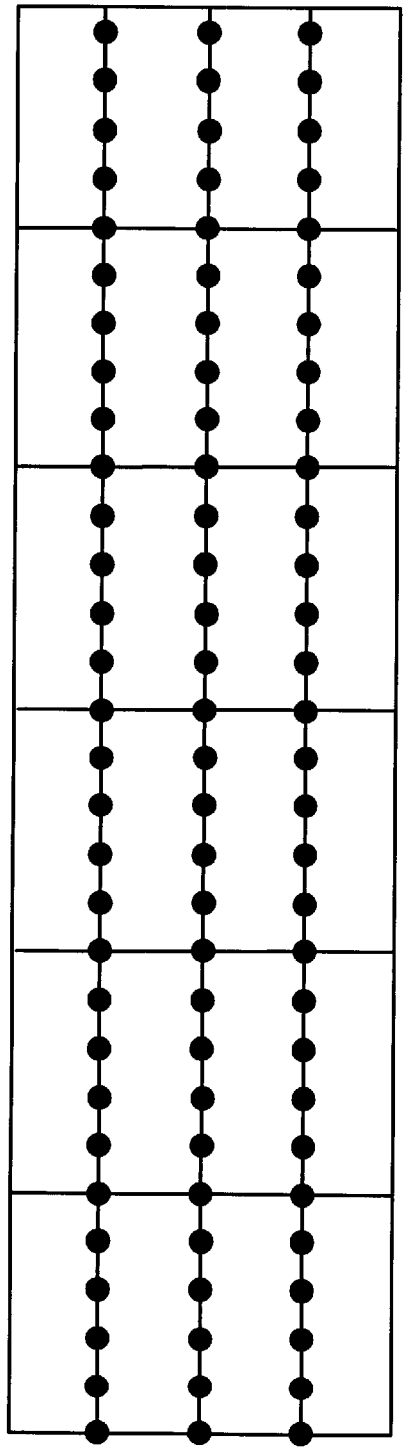
FIGS. 5*a*, 5*b* and 5*c* are illustrations of different dot patterns at different resolutions and scan speeds of the printhead.
Figure 5B:
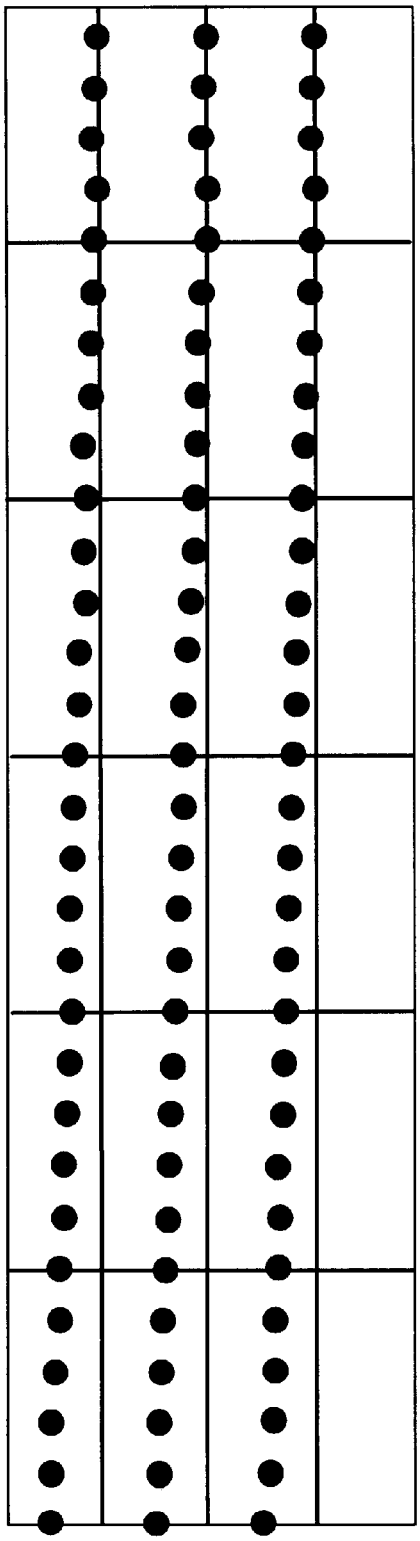
Figure 5C:
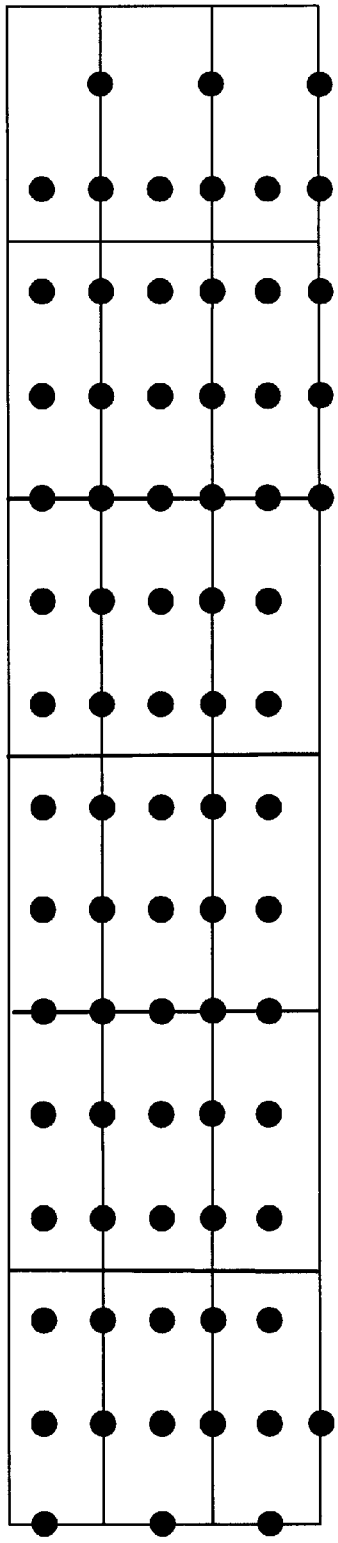

Reference is now made to FIGS. 5*a*, 5*b* and 5*c*, which illustrate different dot patterns that can be printed by a 524-nozzle printhead 12 at a resolution of 600 dpi along the paper flow axis and a maximum resolution of 600 dpi in the scan direction, that is, if all nozzles are fired. The first three rows of nozzles 32 (a total of six nozzles) form a first primitive, the last three rows of nozzles form a last primitive, and the 512 nozzles between the first and last primitives form 16 intermediate primitives, each intermediate primitive having 32 nozzles. The dot pattern of FIG. 5*a* will result if the nozzles are fired at a firing frequency of 12 kHz, a slant angle (θ) of 1.79 degrees and a maximum carriage velocity (Velmax) of 20 ips. The dots lie on a 600 (scan axis)×600 (paper flow axis) grid.

If the scan velocity is increased to 40 ips, the dot pattern of FIG. 5*b* will result. The dots drift within a primitive, thus creating a problem at the primitive-to-primitive boundary. FIG. 5*b* shows a discontinuity between the first primitive and the second primitive.

The nozzle drift may be corrected by rotating the printhead 12 to a slant angle (θ) of 3.576 degrees. With the printhead 12 rotated to a slant angle (θ) of 3.576 degrees, the nozzles 32, 34 are moved further outward. At a slant angle (θ) of 3.576 degrees and a scan velocity of 40 ips, the dots line up on a 600 dpi (scan axis)×300 dpi (paper flow axis) grid. The dots no longer drift within a primitive. Moreover, the discontinuity between the first and second primitives is eliminated. Although resolution is reduced, scan velocity is doubled.

Because the first and second columns of nozzles 32 and 34 are effectively lined up along the vertical (paper flow) axis, the first column may be fired independently of the second column, thus creating two 300 dpi arrays. Primitives may be formed as shown in FIG. 3. The primitives are indicated by dashed lines. A first primitive P1 is made up of three nozzles 32 of the first column, and a second primitive P2 is made up of three nozzles 34 of the second column. A third primitive P3 is made up of sixteen nozzles 32 of the first column, a fourth primitive P4 is made up of sixteen nozzles 34 of the second column, a fifth primitive (not shown) is made up of sixteen nozzles 32 of the first column, a sixth primitive (not shown) is made up of sixteen nozzles 34 of the second column, and so on. The first and second primitives P1 and P2 are paired, the third and fourth primitives P3 and P4 are paired, the fifth and sixth primitives are paired, and so on. Firing of nozzles 34 of the second primitive P2 can be delayed by quarter dot rows with respect to nozzles 34 of the fourth primitive P4, and so on. There is also a delay of several dot rows between the firing of nozzles 32 of the first primitive P1 and the firing of nozzles of the second primitive P2, and so on. Firing of the nozzles in each primitive is rippled one at a time from the first nozzle in the primitive to the last nozzle in the primitive. One nozzle from each primitive is fired at a given time; thus, as many as thirty four nozzles may be fired simultaneously at any given time. By treating each nozzle column as an array, the effective firing frequency becomes twice the actual firing frequency, and the maximum carriage velocity (Velmax) is doubled.

Thus, maximum carriage velocity may be increased to 40 ips for a slant angle of 3.576 degrees, a scan resolution of 300 dpi and an effective firing frequency of 24 kHz and (that is each single-column primitive firing at 12 kHz). Increasing the slant angle to 7.125 degrees can quadruple the scan speed to 80 ips at a scan resolution of 300 dpi. Table 1 indicates certain combinations of parameters. The vertical spacing between the nozzles in a column is fixed, typically at 300 dpi. The velocity is equal to the ratio of effective firing frequency (feff) and scan resolution (Resx). If the carriage velocity is increased to 120 ips, a scan resolution of 200 dpi will result. However, some drift within each primitive could occur.

TABLE 1

| feff (kHz) | actual firing frequency | Slant Angle | Scan Resolution | Printhead Resolution | carriage velocity (ips) |
|---|---|---|---|---|---|
| 12 | 12 | 1.79 | 600 | 600 | 20 |

TABLE 1-continued

| feff (kHz) | actual firing frequency | Slant Angle | Scan Resolution | Printhead Resolution | carriage velocity (ips) |
|---|---|---|---|---|---|
| 24 | 12 | 3.576 | 300 | 300 | 40 |
| 24 | 12 | 7.125 | 300 | 300 | 80 |
| 24 | 12 | 10.62 | 200 | 300 | 120 |

Figure 6:
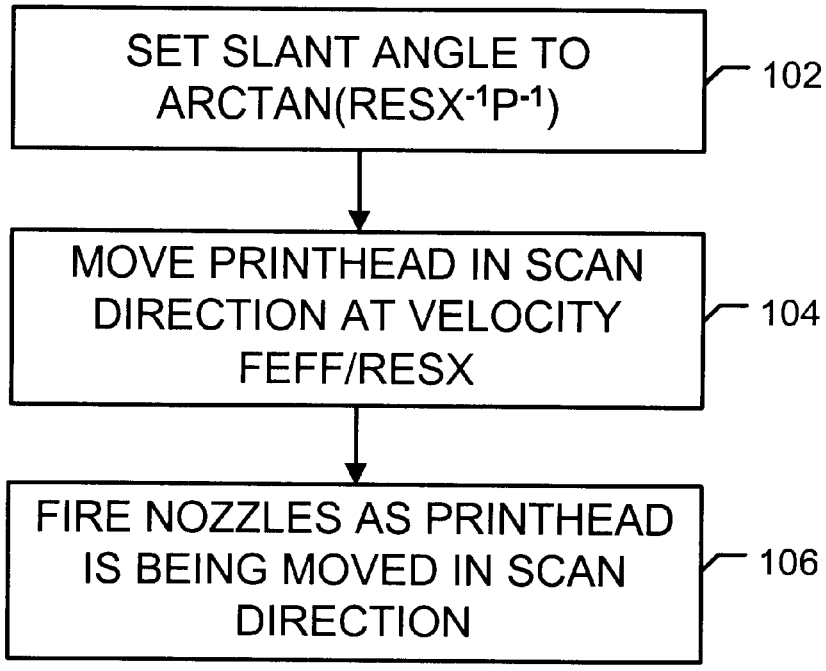
FIG. 6 is a flow chart of a method of using a printhead.

FIG. 6 illustrates a method of using a printhead to print a swath of dots across a sheet. The printhead 12 is set to a slant angle $\theta=\arctan(Resx^{-1}P^{-1})$ (block 102) and thereafter moved in a scan direction at a velocity equal to the ratio of effective firing frequency over desired scan resolution (block 104). As the printhead is being moved in the scan direction, the nozzles are fired (block 106).

A host (e.g. a computer) prints an image by converting the image to swath data and sending the swath data to the printer 10. The printer 10 uses the swath data to fire the nozzles of the printhead(s) 12. If the host generates the swath data for 600×600 dpi printing and sends such swath data to the printer 10, the printer 10 might need to perform a transformation of the swath data. If the actual firing frequency is equal to the effective firing frequency, there is no need to perform the swath data transformation. If, however, the effective frequency is higher than the actual firing frequency (e.g., an effective frequency of 24 kHz and an actual firing frequency of 12 kHz), the swath data is transformed for lower resolution, higher speed printing.

Figure 7:
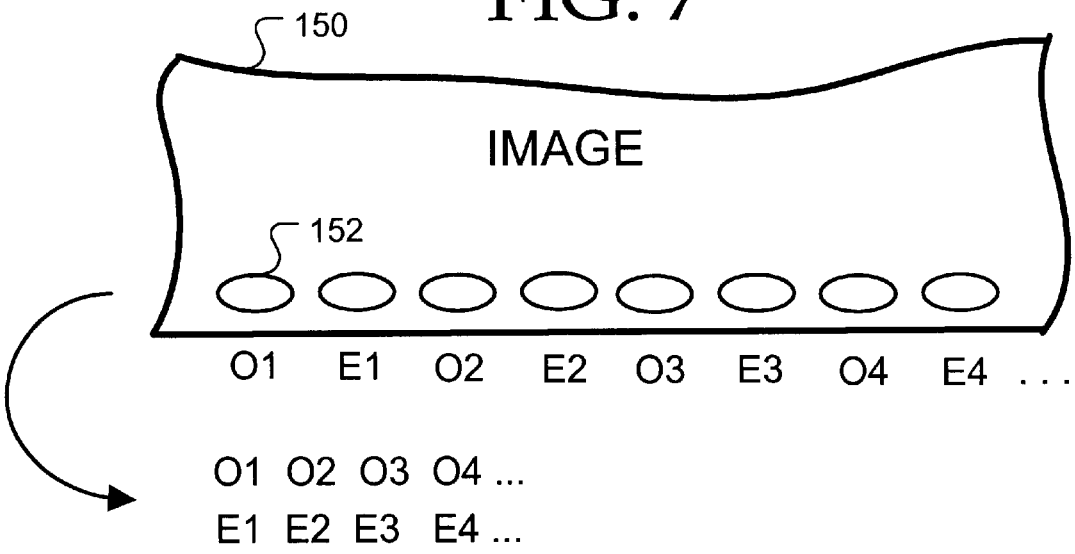
FIG. 7 is an illustration of a swath data transformation.

Reference is now made to FIG. 7, which illustrates how the swath data is transformed. An image 150 is made up of multiple rows 152 of swath data, only one of which rows is shown. If the swath data is initially formatted for 600×600 dpi printing, the odd and even bits O1, E1, O2, E2, . . . for the first and second columns are interleaved. To transform the swath data, the printer 10 de-interleaves the data and uses the odd bits O1, O2, . . . to fire nozzles in odd-numbered primitives and the even bits E1, E2, . . . to fire nozzles in even-numbered primitives.

Thus disclosed is an inkjet printer that can use a printhead having a pair of standard nozzle columns, yet print as much as six times faster than a conventional printer using the same printhead. Although print quality is reduced at the higher printing speeds, the print quality is still acceptable for many types of large-scale printing applications.

The slant angle is not limited to the ratio of the desired scan resolution and the number of nozzles in a primitive. The printheads may be rotated to any angle between about 0 and 11 degrees. As long as the slant angle is not too large, there will not be significant offset between primitives.

The slant angle may be adjusted prior to printing a sheet. The slant angle may also be adjusted in real time, while the sheet is being printed, as carriage velocity is being changed.

Figure 8:
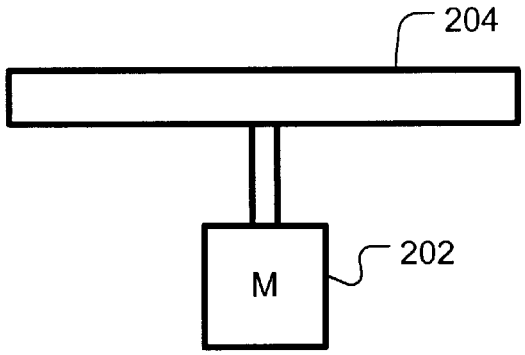
FIG. 8 is an illustration of an alternative carriage assembly for the inkjet printer.

The printer is not limited to a stepper motor and cam for rotating the mounting plate to change the slant angle of the printheads. Slant angle of the printheads may be changed in other ways. For example, FIG. 8 shows a motor 202 that rotates the mounting plate 204 about a mounting plate centroid.

Figure 9:
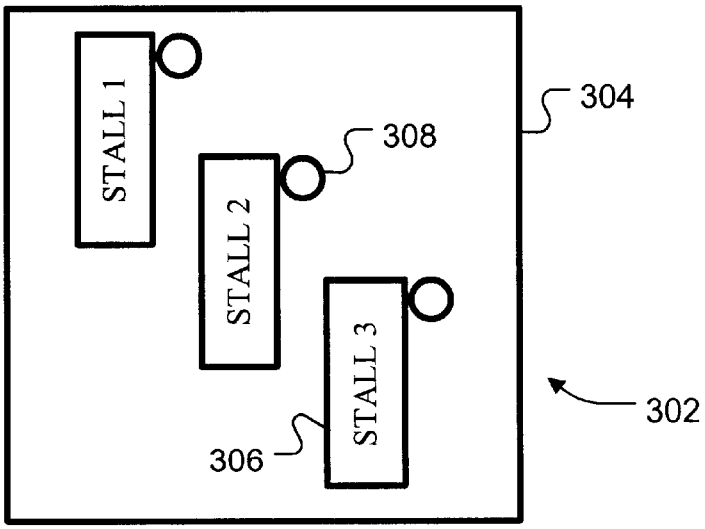
FIG. 9 is an illustration of yet another carriage assembly for the inkjet printer.

Instead, the printer 10 may have a mechanism that moves the printhead stalls individually instead of moving them as a group. FIG. 9, for example, shows a carriage assembly 302 including a mounting plate 304 and three printhead stalls 306. An off-center cam 308 and motor (not shown) are provided for rotating a printhead stall 304.

Figure 10:
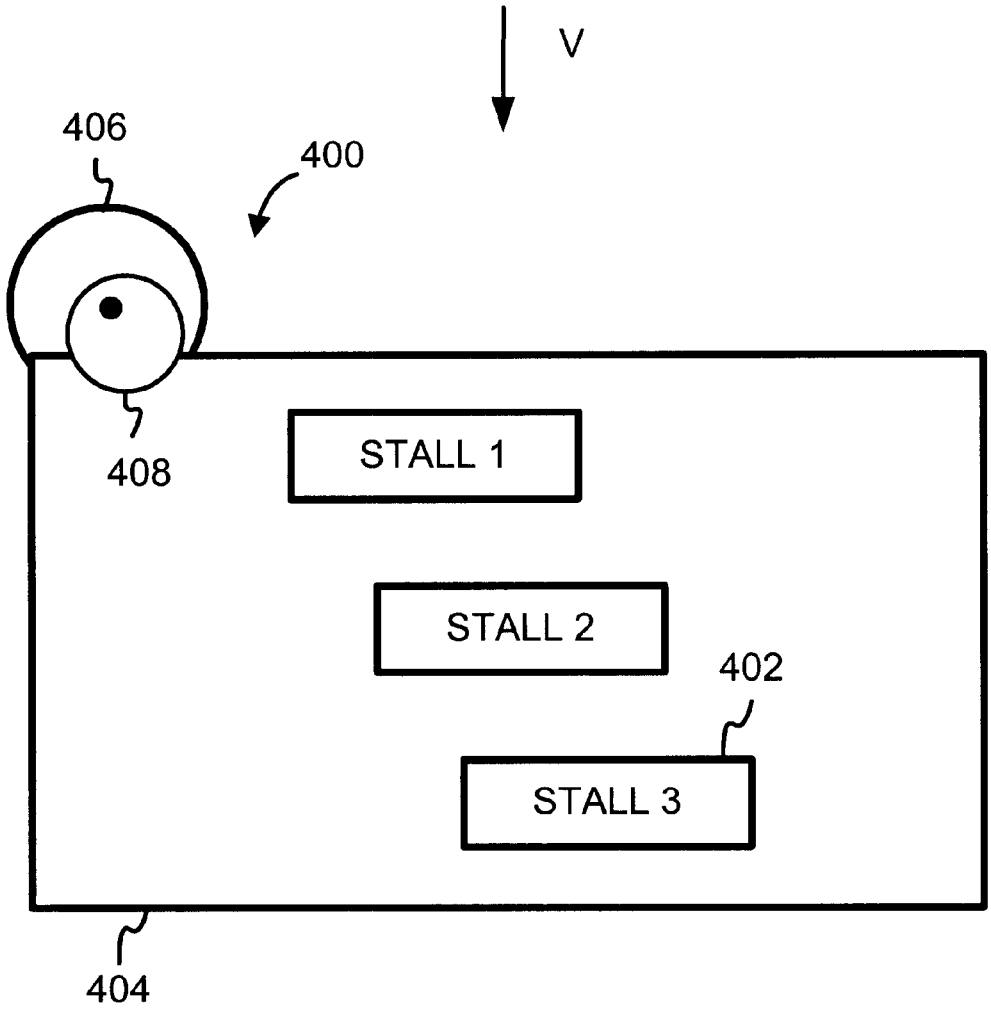
FIG. 10 is an illustration of another inkjet printer according to the present invention.

The printer is not limited to three in-line printheads. Any number of printheads may be used. For example, the dashed portion 25 of FIG. 2 may represent six additional stalls that are offset with respect to the three in-line stalls 24. The slant adjustment is feasible for any printhead configuration, The printer is not limited to printheads that are scanned. Instead, the printer may have stationary printheads. Reference is now made to FIG. 10, which shows an assembly 400 for stationary printheads. Printhead stalls 402 are secured to a plate 404 that is not translatable along the paper flow axis of the printer. A mechanism 406, 408 may rotate the plate 404 about the Z-axis to change the slant angle ($\theta$) between 0 and 11 degrees. During printing, a sheet is moved at a constant velocity along the paper flow axis in the direction of the arrow v. In this assembly 400, the paper flow axis is perpendicular to the pen axis when the slant angle ($\theta$) equals zero. Such a printer can print vertical lines at a resolution of Resx in the paper flow direction.

The invention is not limited to the specific embodiments described above. Instead, the invention is construed according to the claims that follow.

What is claimed is:

1. A printer for using a printhead containing nozzles having primitive separation, the printer having a paper flow axis, a scan axis and a Z-axis that is orthogonal to the scan and paper flow axes, the printer comprising:

a printhead stall rotatable about the Z-axis;

a mechanism for rotating the printhead stall about the Z-axis; and a controller for controlling the mechanism to change slant angle of the printhead stall as a function of the primitive separation.

2. The printer of claim 1, wherein the slant angle can be changed between about 0 to 11 degrees.

3. The printer of claim 1, wherein the slant angle $\theta=\arctan(Resx^{-1}P^{-1})$, where Resx represents scan resolution and P represents the primitive separation.

4. The printer of claim 1, further comprising means for controlling a printhead including first and second columns of nozzles; wherein the means causes the nozzles of the first column to fire at maximum frequency and the nozzles of the second column to fire at maximum frequency; whereby the nozzles are fired at an effective firing frequency that is twice the maximum firing frequency.

5. The printer of claim 4, wherein each primitive is made up of nozzles from a single column; and wherein primitives of the first column and paired with primitives of the second column.

6. The printer of claim 1, wherein the printhead stall is secured to a mounting plate, and wherein the mechanism can move the mounting plate to adjust the slant angle.

7. The printer of claim 1, wherein the mechanism directly moves the printhead stall to adjust the slant angle.

8. The printer of claim 1, wherein the controller causes the mechanism to change the slant angle prior to starting a print job.

9. The printer of claim 1, further comprising a mechanism for creating a relative motion between the sheet and the printhead in a scan direction at a speed equal to the ratio of effective firing frequency over desired scan resolution.

10. The printer of claim 1, further comprising a carriage for the printhead stall, wherein carriage velocity is equal to the ratio of maximum firing frequency to scan resolution.

11. The printer of claim 1, wherein the slant angle is also a function of scan resolution.

12. An assembly for at least one printhead of a printer, the printer having a paper axis and a scan axis, the at least one printhead containing nozzles having primitive separation, the assembly comprising:

a mounting plate;

a printhead stall mounted to the mounting plate; and a mechanism for rotating the printhead stall to a slant angle between about 0 and 11 degrees, wherein the slant angle=arctan($Resx^{-1}P^{-1}$), where Resx represents scan resolution and P represents primitive separation.

13. The assembly of claim 12, wherein the mechanism moves the mounting plate to adjust the slant angle.

14. The assembly of claim 12, wherein the mechanism directly moves the printhead stall to adjust the slant angle.

15. An inkjet printer comprising:

means for carrying at least one printhead containing nozzles; and means for rotating the carrying means about a Z-axis to a slant angle of arctan ($Resx^{-1}P^{-1}$), where Resx represents scan resolution and P represents primitive separation of the nozzles.

16. The printer of claim 15, wherein the rotating means can rotate the carrying means according to a desired print speed.

17. The printer of claim 15, wherein at least one printhead has two columns of nozzles; and wherein the printer further comprises means for firing each of the two columns at a maximum firing frequency.

18. A method of using a printhead to print a swath of dots across a sheet, the printhead containing nozzles having a primitive separation, the method comprising:

setting a slant angle as a function of scan resolution and the primitive separation;

creating a relative motion between the sheet and the printhead in a scan direction at a speed equal to the ratio of effective firing frequency over desired scan resolution; and firing the nozzles at maximum actual frequency while the relative motion is being created.

19. The method of claim 18, wherein the printhead includes first and second columns of nozzles; and wherein the nozzles of the first column are fired at the maximum frequency and the nozzles of the second column are fired at the maximum frequency; whereby the nozzles are fired at an effective firing frequency that is twice the maximum firing frequency.

20. The method of claim 18, wherein each primitive is made up of nozzles from a single column; and wherein primitives of the first column and paired with primitives of the second column.

21. The method of claim 18, wherein the slant angle is changed prior to starting a print job.

22. A printer having a paper flow axis, the printer comprising:

a pen including first and second columns of nozzles; and a mechanism for rotating the pen to a slant angle so that the nozzles of the first and second columns, after rotation, are aligned along the paper flow axis, the slant angle being a function of primitive separation of the nozzles.

23. The printer of claim 22, further comprising means for firing the first and second columns of nozzles independently such that each primitive consists of nozzles from only one of the columns.

24. The printer of claim 22, wherein the slant angle is arctan ($Resx^{-1}P^{-1}$), where Resx represents scan resolution and P represents the primitive separation.

25. The printer of claim 22, further comprising a carriage for the printhead, wherein carriage velocity is equal to the ratio of maximum firing frequency to scan resolution.

* * * * *